US006234406B1

(12) United States Patent
Thomas

(10) Patent No.: US 6,234,406 B1
(45) Date of Patent: May 22, 2001

(54) BLASTING NOZZLE WITH WELDED LANCE HEAD FOR THE AGITATION OF BATHS

(76) Inventor: Jacques J. A. Thomas, Avenue de Nandrin, 42, 4130 Esneux (BE)

( * ) Notice: Subject to any disclaimer, the term of this patent is extended or adjusted under 35 U.S.C. 154(b) by 0 days.

(21) Appl. No.: 09/435,469

(22) Filed: Nov. 8, 1999

Related U.S. Application Data

(63) Continuation-in-part of application No. 08/973,203, filed on Dec. 17, 1997, now abandoned, which is a continuation of application No. PCT/BE96/00068, filed on Jun. 24, 1996.

(30) Foreign Application Priority Data

Jun. 23, 1995 (BE) ..... 9500556

(51) Int. Cl.[7] ..... B05B 1/24

(52) U.S. Cl. ..... 239/132; 239/132.1; 239/132.3; 239/461; 239/591

(58) Field of Search ..... 239/132, 132.1, 239/132.3, 461, 591, DIG. 19

(56) References Cited

U.S. PATENT DOCUMENTS 3,322,348 * 5/1967 Vonnemann ..... 239/132.3
3,322,419 * 5/1967 Smith et al. ..... 239/132.3
3,559,974 * 2/1971 Berry ..... 239/132.3
3,647,147 * 3/1972 Cook ..... 239/599
3,730,505 * 5/1973 Ramacciotti et al. ..... 239/132.3
3,750,952 * 8/1973 Schweng et al. ..... 239/132.3
4,052,005 * 10/1977 Rymarchk, Jr. ..... 239/132.3
4,301,969 * 11/1981 Sharp ..... 239/132.3
4,432,534 * 2/1984 Zanetta et al. ..... 239/132.3 X
4,632,401 * 12/1986 Kar et al. ..... 29/402.02 X

* cited by examiner

*Primary Examiner*—David A. Scherbel
*Assistant Examiner*—Robin O. Evans
(74) *Attorney, Agent, or Firm*—Sughrue, Mion, Zinn, Macpeak & Seas, PLLC

(57) ABSTRACT

A metallurgical or chemical oxygen nozzle including an oxygen lance head (1) for pointing at a metallurgical melt. The nozzle comprises a front surface (40) and an assembly of at least two substantially concentric tubes (20, 30), said front surface (40) being made of electrolytic copper. The front surface (40) is joined (52) to said tubes (20, 30) by high-energy density welding, the head is made of a number of head elements each of which consists of a material specifically selected for the respective head element, and said head elements are all joined by high-energy density welding.

23 Claims, 5 Drawing Sheets

BLASTING NOZZLE WITH WELDED LANCE HEAD FOR THE AGITATION OF BATHS

CROSS-REFERENCE TO RELATED APPLICATION

This application is a Continuation-in-part to commonly assigned application, Ser. No. 08/973,203 filed on Dec. 17, 1997 now abandoned. This application is also a continuation of PCT/BE96/00068.

FIELD OF THE INVENTION

The present invention relates to a blasting nozzle comprising a lance head intended to be turned towards an iron-and-steelmaling melting bath or chemical reactor respectively having a front face and a set of at least two approximately concentric tubes. The front face is made of a material having a high thermal conductivity, in particular electrolytic copper.

STATE OF THE ART

In known heads forming the front face of the nozzle, the latter is made of electrolytic copper allowing good heat extraction due to its known property of being a good thermal conductor. It is known to attach the front face to the steel tubes by welding or brazing. However, the welds conventionally used in the iron-and-steelmaking field, and even the metallurgical and chemical field, have the drawback of being produced only with difficulty for reasons which are specifically metallurgical, while allowing sealing defects to appear. Thus, leaks occur in the region of the copper-steel welded joint zones. In addition, the existing heads very rapidly become downgraded, requiring quite frequent head replacements during production, which is a nuisance. A blasting nozzle is known from "Steel in the USSR, vol. 19, No. 2, 1989, pages 38–40 entitled "Lances for 250 t converters" by A. G. Chernyatevich". which simply describes a way of attaching the lance head to the set of tubes by welding.

AT-A-313945, describes a lance head for oxygen blasting lances and for burner lances having outlet orifices, in particular for oxygen and/or fuel, in which the outlet surface of the nozzle head and the internal surfaces of each outlet orifice are covered with a layer of molybdenum.

DESCRIPTION OF THE INVENTION

The object of the invention is to remedy these drawbacks, while presenting a more specific embodiment. To this end, the said front face is attached to the said tubes by high-energy density welding, the aforementioned head being made of several head components, each head component being made of a material chosen selectively depending on the function to be fulfilled by the respective head component and the said head components are all fixed by high-energy density welding, in particular by electron-beam welding.

In another (particularly advantageous) embodiment of the invention, the aforementioned welding is carried out by laser welding. By virtue of this particular type of welding, copper-steel joints are obtained, the welding of which is easy to carry out.

To this easy welding may be furthermore added the fact that the copper-steel joint provides good sealing, both from the standpoint of flowing fluids and of temperature. The lifetime of the nozzle according to the invention is thereby considerably increased. Moreover, each welding zone is able very well to withstand the fatigue stresses due to the successive thermal cycles to which the blasting nozzles and their lance heads are subjected.

As a result of the extremely low wear in service, obtained by virtue of the lance head according to the invention, the working parameters are made particularly stable throughout the lifetime of the lance head and, as a very remarkable advantage, the steel production may thus be easily automated. This is because, since the strength and reliability are improved, less surveillance is necessary. As regards the frequency of replacing the lance head, this is markedly reduced, thereby avoiding the interruptions to the production process for the reason of carrying out maintenance on the head or for replacing it. In contrast, the bushes of the known nozzles have a marked tendency to wear out quite rapidly. There is a very wide spread in the distribution of lifetimes of the known heads, while with the invention, good reproducibility quality is obtained given the stability of the head-construction parameters.

One problem which occurs is the fact that the head, which has outlet orifices also made of electrolytic copper for the same reasons of good thermal conductivity, erodes quite rapidly in the region of the said outlet orifices, in particular in the case of oxygen blasting. This is the because, in the case of oxygen blasting, the problem of head longevity is particularly acute given the highly abrasive action of oxygen. This ends up by leading to a loss of efficiency of the oxygen lance and even to incorrect operation of the latter, which results in dispersion of the jet caused by the aforementioned erosion, giving rise to what is called the umbrella effect, thereby reducing the effectiveness of the agitation of the bath. In order to solve this additional problem, the nozzle is made of a material especially intended for this purpose, in particular a wear resistant bronze.

Thus, for the front face, which is initially one-piece, the nozzle itself is made of an erosion-resistant material. This is specifically made possible by virtue of another further advantage of the manner of attaching the front face to the tubes by electron-beam welding, residing in the fact that the latter allows welding without any stress, even a low stress, and without any distortion of the welding zone. The effect of this is that the nozzle exposed to the erosion phenomenon may thus be produced so as to combat the latter effectively. What is more, according to an additional embodiment of the nozzle according to the invention, the nozzle is provided with at least a certain number of outlet orifices, advantageously at least three, making it possible to ensure, in combination with their considerably increased resistance, a more uniform melting or reaction bath. This measure thus contributes to improving the agitation of the aforementioned bath considerably.

Other advantages and features of the nozzle according to the present invention will emerge from the description given below of an exemplary embodiment of the latter, illustrated by means of the appended drawings.

DESCRIPTION

In general, the present invention relates to blasting nozzles for both iron-and-steelmaking and chemical applications, with a lance bead to be directed respectively towards a melting bath and towards a chemical reactor, in each of which it is necessary to manage the agitation of liquid masses. This emerges from the above description of the invention. However, the description below will be more specifically focused on the iron-and-steelmaking application field, in particular oxygen blasting nozzles with an oxygen lance head, for the sake of clarity.

Figure 1:
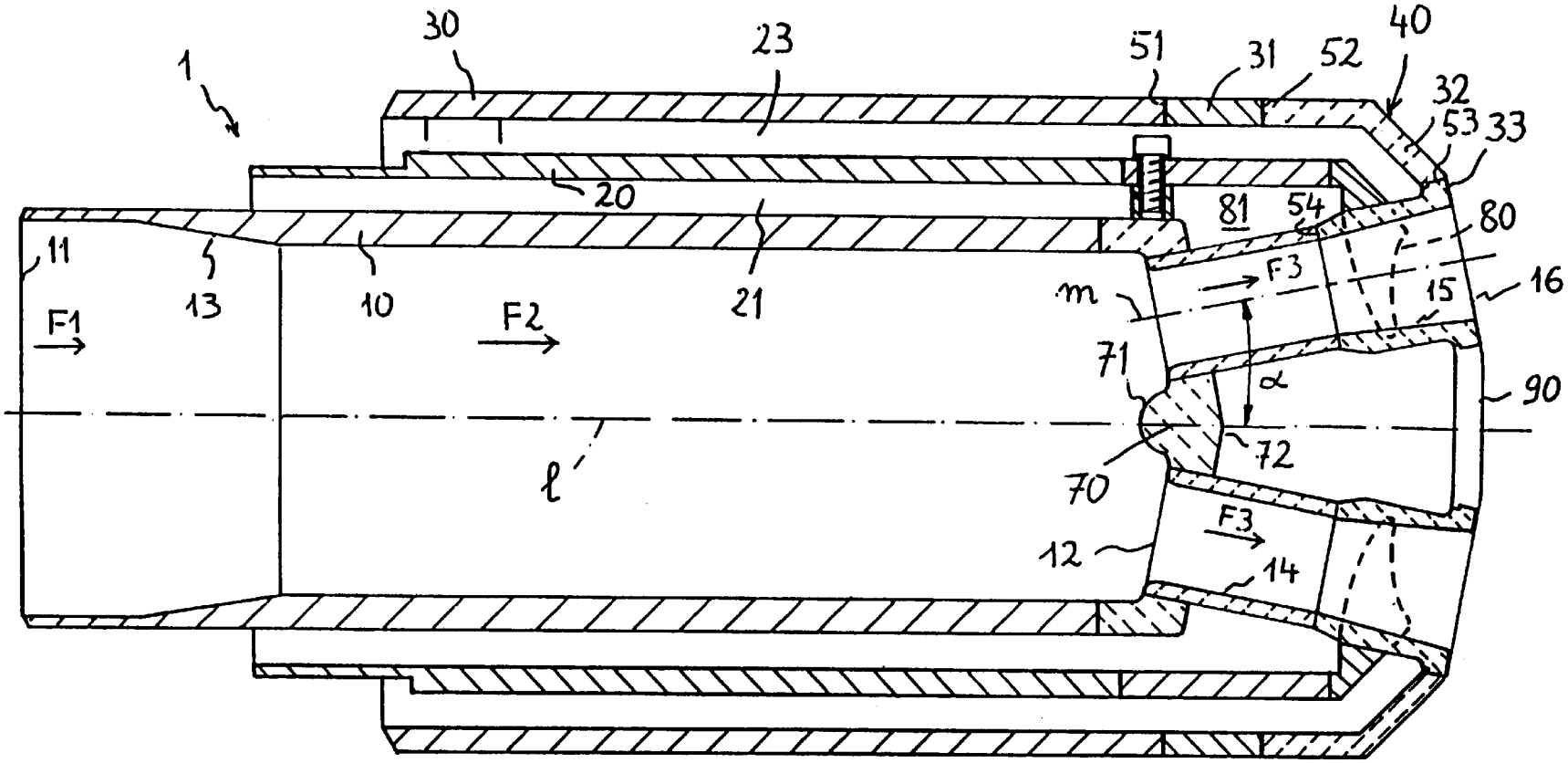
FIG. 1 represents a longitudinal sectional view of an oxygen lance head of a nozzle according to the invention.

The oxygen lance head 1 illustrated in longitudinal section in FIG. 1 comprises a central, practically cylindrical, pipe 10 with a longitudinal axis 1, intended for the flow of oxygen to be directed on to a melting bath, not shown. The working distance is typically in the range of 1 to 2.5 meters. The bath temperature may be in the range of 1400° C. In those working conditions the temperature of the head may increase to 400° C. After operating in that environment for approximately 20 minutes the lance is withdrawn the temperature of the head quickly returns to ambient conditions, i.e. 20° C. Consequently, the lance head is subjected to a significant thermal cyclic variation during use. Upstream, the said central pipe 10 has an inlet opening 11 and, downstream, the outlet is subdivided into a certain number of outlet openings 12 forming the inlet of corresponding outlet pipes 14, each of which terminates in outlet orifices 16. The internal cross-section of the central pipe 10 has at least one region 13 in which it narrows down to accelerate the oxygen flowing along the directions of the arrows indicated respectively by F1 and F2. This acceleration phenomenon is further increased after entering the outlet pipes 14, the useful oxygen flow area being each time greatly reduced by the arrangement of several outlet orifices having a cross-section much smaller than the central pipe 10.

The outlet orifices 16, which are, for example, three in number, are advantageously arranged in a ring around the longitudinal axis 1. Preferably, the respective longitudinal axes m of the outlet pipes 14 are slightly inclined at an angle a with respect to the longitudinal axis 1 of the central pipe 10 so as to obtain a divergent nozzle, the problem of premature wear being in this case even more acute. This is because rapid erosion of the outlet pipes 14 would also have the consequence of increasing the angular aperture a of the nozzle cone excessively, something which would inevitably lead to incorrect operation of the lance. The precipitated erosion of the nozzle which may thus occur then leads to a considerable loss of effectiveness of the blasting nozzle, which may then lead, in known cases, to downgrading of the nozzle.

In contrast, in the nozzles according to the invention, the outlet pipes 14, in particular the terminal downstream regions 15 of the latter, these lying in the region of the respective outlet orifices 16, are made of a highly resistant material such as an anti-refractory bush of a nickel based alloy to combat the erosion phenomenon effectively and to do so despite a greatly increased velocity of the oxygen flowing along the direction indicated by the arrow F3, which oxygen is, in addition, generally laden with highly abrasive dust.

The typical pressure for blasting pure oxygen is approximately 10 bars. The velocity of the oxygen is in the range of 800–1600 m/sec. As a result, the oxygen has a strong mechanical effect on the nozzles walls resulting in erosion, particularly when the nozzles are heated. The effect of erosion is that the nozzle orifice opens thus reducing the efficiency of the injection of oxygen in the bath. The rate of oxygen may be in the order of 500 $m^3$/h to 120 $m^3$/h. With rates of flow this high erosion by cavitation of the central portion of the lance may also occur.

Figure 5:
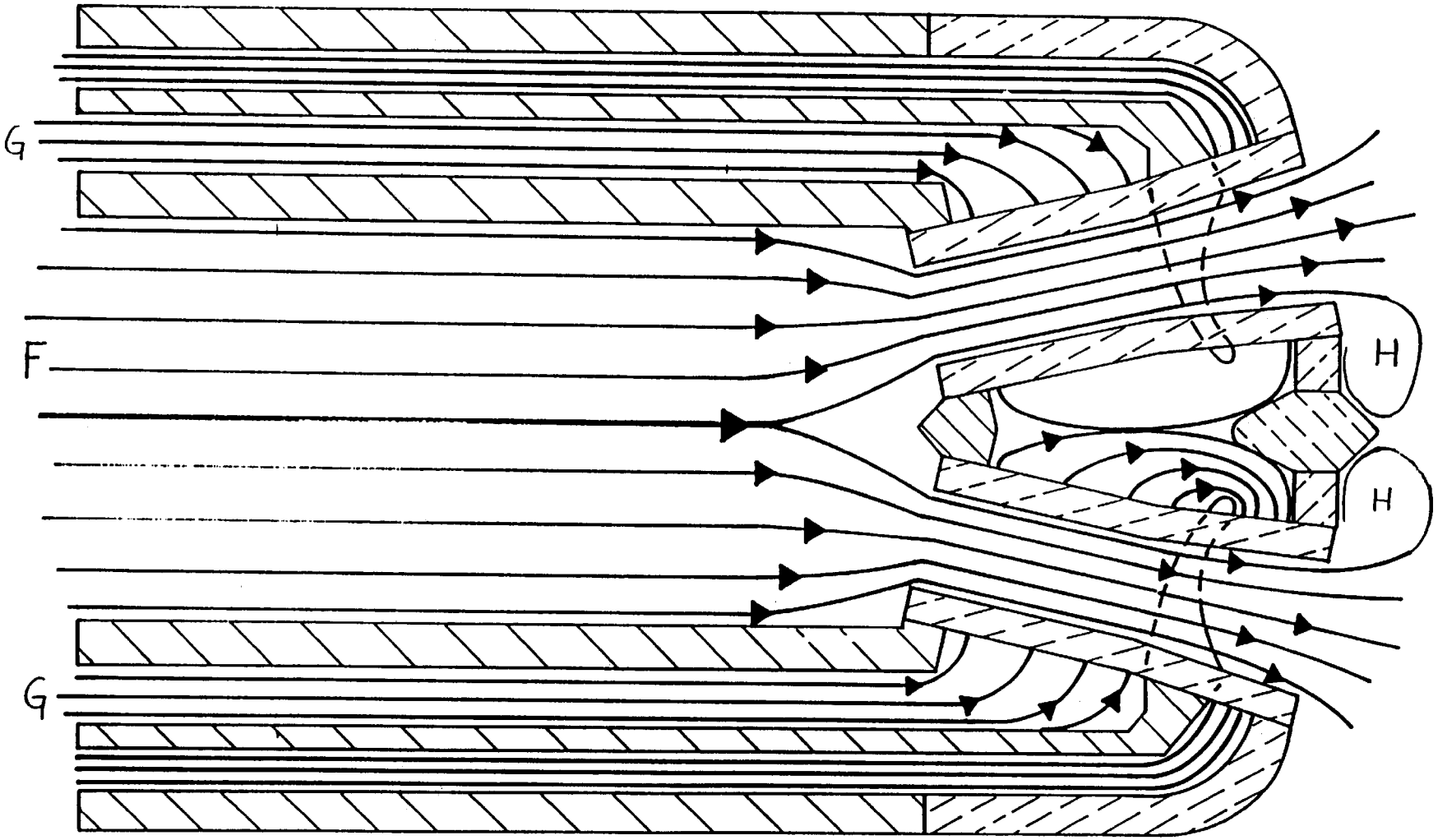
FIGS. 5 and 6 represent views of components identical to FIGS. 3 and 4 with diagrammatic representation of the flow profiles of the flowing fluids for blasting and for cooling.
Figure 6:
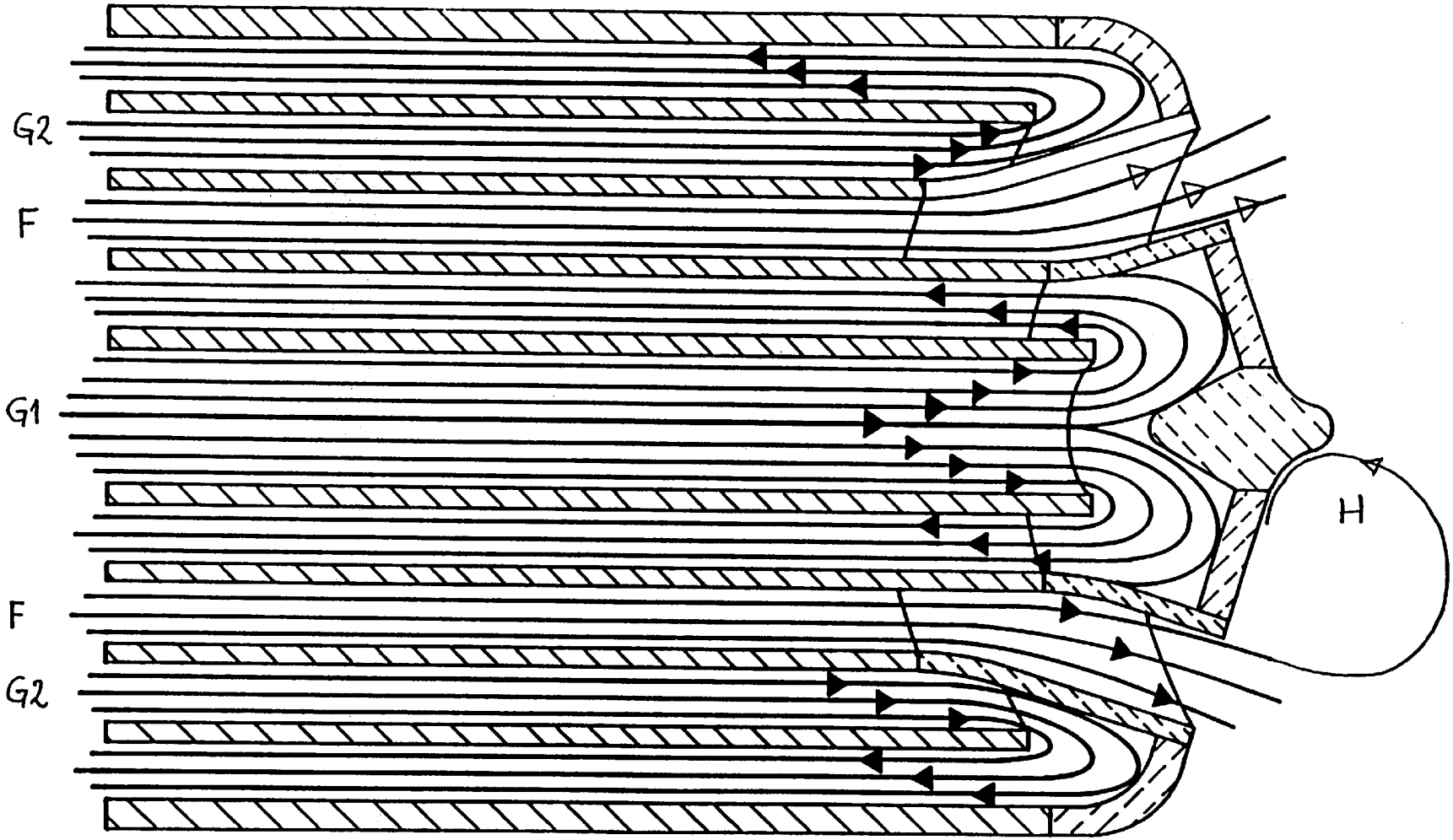

Around the central oxygen-feed pipe 10, the nozzle furthermore has at least one, preferably a set of at least two pipes 20, 30 having the same approximately cylindrical aspect as the central pipe 10 and concentric with the latter. Formed between the said pipes, or the inner tube 10, the intermediate tube 20 and the outer tube 30, are approximately annular spaces 21, 23 serving as a circuit for supplying a coolant. Diagrammatic representations of the circuits and paths of the fluids are shown in FIGS. 5 and 6.

The lance head is cooled by water circulation therein. The typical water pressure is 10 to 20 bars. In order to obtain sufficient cooling, the material separating the cooling water from the exterior surface must also be a good heat conductor.

Furthermore, the aforementioned pipes 20, 30 also serve as a mechanical support for a front part 40 constituting the head proper, which is intended to be turned towards the melting bath. This part 40 is made of a material allowing excellent heat extraction, preferably copper, due to its good thermal conductivity. The front part 40 is attached to the pipe or outer tube 30 at a joint zone 51, 52, the attachment being produced by welding. However, conventional copper-steel welds can only be produced with difficulty for metallurgical reasons. In addition, they allow sealing defects to appear, leaks thus being produced in the region of the joint zones 52.

In order to solve this problem, special welding is used according to the invention, in particular electron-beam welding. Thus, by virtue of the invention, the welding of the copper-steel joint zones is not only easily able to be carried out, since it allows direct welding, without the addition of welding material, but furthermore the weld obtained gives an optimum sealed joint, including with regard to temperature. Thus, the cooling circuit 81 is perfectly sealed.

An additional advantage of electron-beam welding is associated with the fact that it allows welding without any stress, even a low stress, and without any distortion, thereby making it possible to produce a nozzle, normally subjected to considerable erosion, from an ultraresistant material especially intended for this purpose. Thus, the nozzle itself is constructed from an erosion-resistant material, particularly in the central portion. The front piece 40 is initially one-piece which is high in heat conductivity to provide for good heat transfer.

This results in the nozzle according to the invention having a considerably increased lifetime, the base nozzle allowing oxygen to flow at high velocity and making it possible, furthermore, to transfer the heat absorbed because of the closeness of the melting bath by the coolant, to seal the cooling circuit and to resist the abrasion and wear of the divergent outlet pipes, these being caused by the high-velocity flow of the oxygen which is often laden with abrasive particles. Tests have demonstrated that the lifetime of the nozzles according to the invention may be increased up to at least 500 heats, representing a substantial breakthrough compared to the known lifetimes, namely practically an increase by a factor of 2 in lifetime. This represents a particularly advantageous threshold above which it is possible to save on replacing heads per converter, resulting in a substantial increase in production rate and consequently yield. Thus, better stability and erosion resistance of the nozzle cones m allow a more reliable use of the equipment.

Another major advantage which results from the remarkable increase in the lifetime of the nozzles resides in the fact that the working parameters are made particularly stable throughout the lifetime of the lance head because of the very low wear encountered in service. As a result of this stability, it is possible to envisage easy automation of the steel-smelting process with the use of the lance head according to the invention.

Moreover, all the aforementioned functional roles cannot easily be provided, on the one hand, by a single material, as in the known configurations, and in particular of the one-piece head type, and, on the other hand, by simple attachment by brazing. In contrast, in the nozzle according to the invention, the head is made of several components, in particular the terminal regions of the pipes 15, the outer tube 30, the intermediate outer tube 31, the cap 32 and the "nozzle cones" 33, which are made of a material judiciously chosen depending on the functional role that each of them has to play. Thus, the modular design of the head 1 is able to simplify the possibility of modifying the geometry of the latter, in particular with regard to the angles $\alpha$, the diameter of the outlet orifices, etc. This modular replaceability is particularly important in the case of adjusting the head when it is desired to switch from a given agitation application to another. In addition, the head components, should they become defective, can be replaced selectively. Thus, the cost of modifying the head is considerably reduced.

Figure 4:
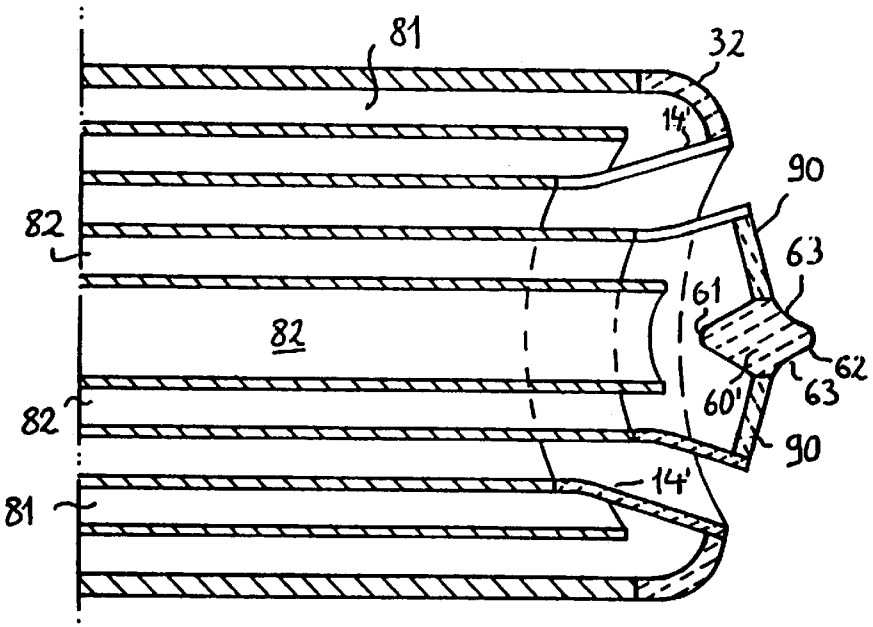
FIGS. 3 and 4 represent views similar to FIG. 2 of an alternative form of nozzle according to the invention, flanked by an additional functional component.

Moreover, the modular design of the head thus produced makes it possible to adapt the number of outlet pipes, or indeed to replace them with an uninterrupted ring to produce a continuous annular jet, as illustrated in FIG. 4.

These components are then fixed, respectively, at 51, 52, 53, 54, in a homogeneous manner by high-energy density welding, preferably by electron-beam welding.

Another problem encountered when blasting at a high rate, such as 500 $m^3/h$ for example, is the cavitation erosion of the center of the head. This erosion is suppressed by the arrangement, at the center of the head, of a deflector 60 advantageously made from the same material as the outlet pipes 14. This deflector 60 has a concave shape matched to the exit velocity of the oxygen and is fixed in a sealed manner to the head, preferably by an electron beam or by another suitable means. In its inner part 61, it also serves as a deflector for the coolant, as may be seen in FIGS. 5 and 6.

However, it should be noted that, for the purpose of stirring the baths more strongly, the blasting flow rates may be increased up to 800 $m^3/h$ or 1000 $m^3/h$, or even up to 1200 $m^3/h$. The higher rates may cause a cavitation movement resulting in a return movement of the agitating streams or flows, such that it may lead eventually to perforation of the central component 90. The formation of such a hole may be avoided by means of the appropriate arrangement of the outer deflector component 60, preferably practically at the center of the longitudinal axis 1.

Furthermore, it may also be advantageous to provide an inner deflector 70 intended to deflect, in an appropriate manner, the oxygen leaving the central pipe 10 in order to enter the outlet pipes 14. Furthermore, the inner deflector 70 acts as a heat pump. By virtue of its more pronounced projecting shape 71 upstream with respect to the direction of flow, it acts effectively as a flow divider while its slightly projecting shape 72 downstream allows the agitation flows to be properly guided. The upstream projections 61; 71 may have a more rounded appearance as shown in FIG. 1 or a more pointed appearance as shown in FIG. 2.

In order to ensure that the profile of the outer deflector 60' properly matches the agitation backflows H, the downstream projecting part may advantageously have, on each side of the end 62, concave parts 63 which are attached thereto in order to provide perfect guiding and to avoid any formation of turbulent flows in this region.

Figure 2:
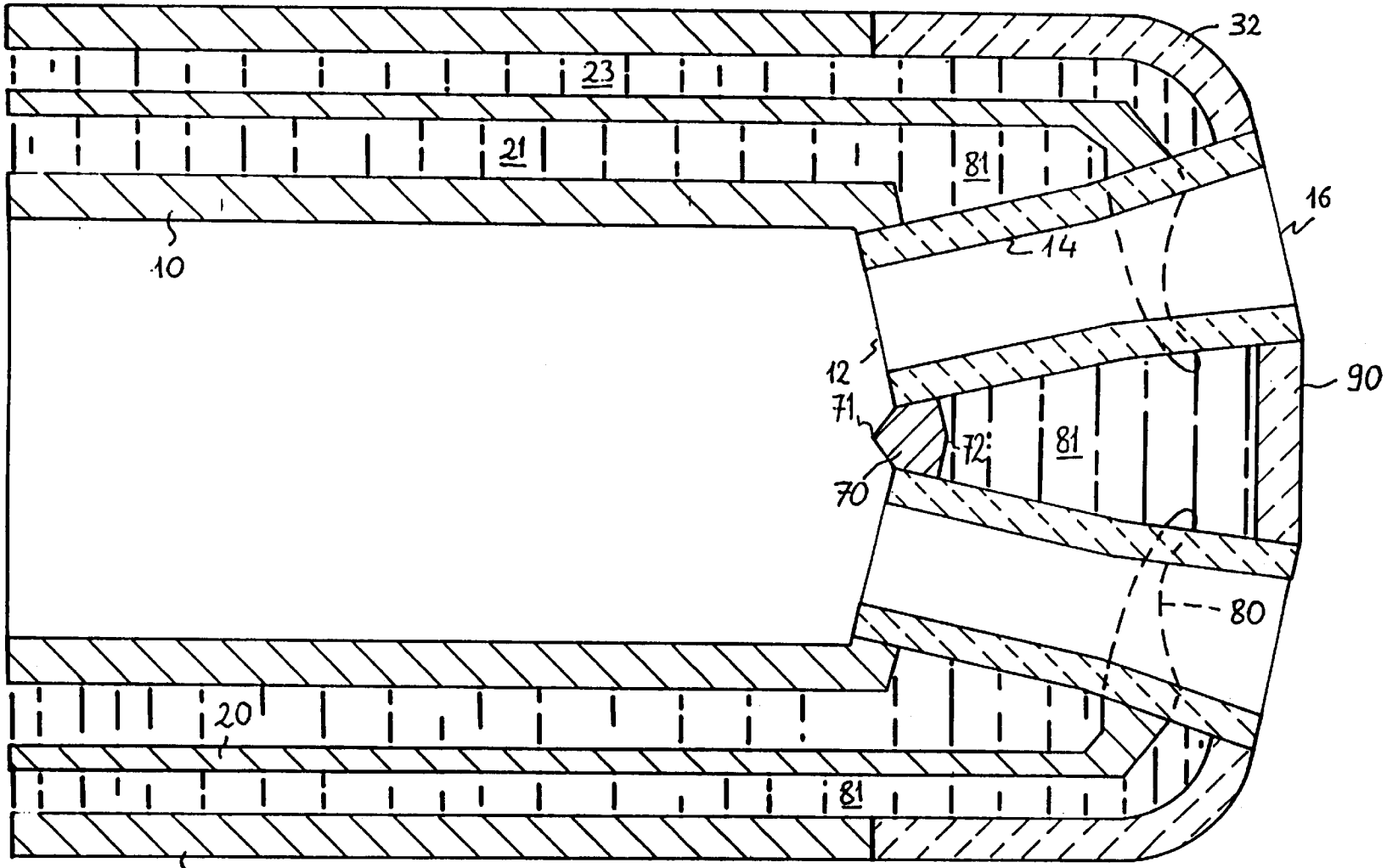
FIG. 2 represents a partial view of a nozzle, similar to FIG. 1.
Figure 3:
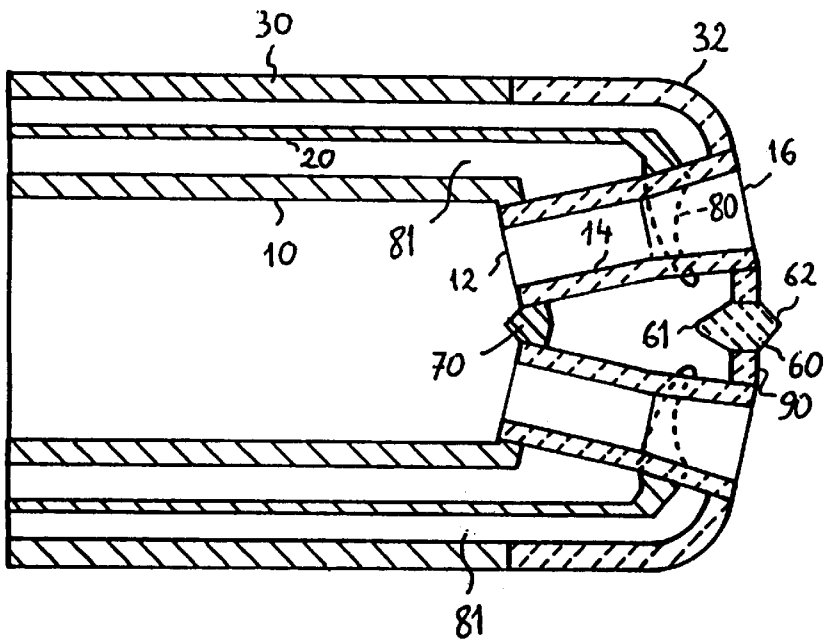

The end components so of each of the cooling circuits 81 have a profile which is particularly appropriate to good flow of the coolant at the downstream ends of the cooling circuit, such as a duckbilled cross-section, as shown in FIGS. 1 to 3.

One way in which the coolant can flow with respect to the agitating flow formed by the oxygen flow is shown in FIG. 5. Advantageously, the direction of flow G of the coolant in the cooling channel 21 adjacent to the central tube 10 may be reversed with respect to the direction of flow F2 of the oxygen so as to increase the cooling effect by promoting heat transfer from one to the other.

Another alternative embodiment with regard to the cooling circuits is illustrated in FIG. 4. This in fact shows the arrangement of two cooling circuits, one 81 being lateral, as in the case of FIG. 2, and the other 82 being central, allowing separation into outer 82 and inner 81 water-cooling circuits so as to cool the central axis of the head. Thus, the presence of the inner cooling circuit 81, which is central, makes it possible to cool, directly and with the entire force of the flow, the pointed deflector 60 corresponding to the outer deflector indicated above, as illustrated in FIG. 6. The representation in FIGS. 5 and 6 clearly illustrates that the arrangement of the deflectors favorably influences the flow of the fluids by substantially reducing the possibility of forming turbulent regions.

As indicated above, it is understood that fields of application other than that thus described also fall within the scope of the present invention, and in particular that of blasting nozzles intended for agitating fluids in particular in the chemical industry. This is because the phenomenon of wear of the blowpipe for activating chemical reactors by agitation in the baths is also well known. The structural design of the lance heads according to the present invention may also solve this problem by means of a judicious choice of the materials depending on the nature of the baths to be agitated, without departing from the scope of the present application.

What is claimed is:

1. A blasting nozzle for the agitation of baths, comprising:

a set of two substantially concentric tubes;

a lance head intended to be turned towards an iron-and-steelmaking melting bath or a chemical reactor and to be subjected to significant thermal variations, having a front face and at least one outlet pipe which terminates in an outlet orifice, said front face being made of a material having a high thermal conductivity, wherein said front face is attached to the said tubes by a high-energy-density welding and the aforementioned head comprises a plurality of head components, including said front face and said outlet pipe, that are made of distinctly different materials, each head component being made of material chosen selectively among metallic materials which are distinct depending on the function to be fulfilled by the respective head component, said head components all being fixed in mutual attachment zones by high-energy welding.

2. Nozzle according to claim 1, wherein the high-energy-density welding consists of laser welding.

3. Nozzle according to claim 1, wherein the high-energy-density welding consists of electron-beam welding.

4. Nozzle according to claim 1, wherein said lance head comprises at least one copper-steel attachment.

5. Nozzle according to claim 1, wherein the said front face is made of electrolytic copper or of a copper-based material.

6. Nozzle according to claim 1, wherein said at least two substantially concentric tubes are made of the same aforementioned highly wear-resistant and abrasion-resistant material.

7. Nozzle according to claim 1, wherein said highly wear-resistant and abrasion-resistant material includes a material able to resist wear at high temperature.

8. Nozzle according to claim 1, wherein the terminal portion of at least one outlet pipe is a bush.

9. Nozzle according to claim 4, wherein said at least two substantially concentric tubes are made of an erosion-resistant steel.

10. Nozzle according to claim 7, wherein the said highly wear-resistant and abrasion-resistant material consists of a wear-resistant bronze.

11. Nozzle according to claim 1, wherein the number of outlet orifices is increased to at least three.

12. Nozzle according to claim 11, wherein said outlet orifices are arranged in a ring centered with respect to the longitudinal axis of the lance head.

13. Nozzle according to claim 4, wherein the outlet orifice has an annular shape extending so as to be approximately centered around the longitudinal axis of the nozzle.

14. Nozzle according to claim 4, wherein the lance head include a plurality of said outlet pipes and wherein said outlet pipes are each oriented divergently with respect to the longitudinal axis of the nozzle.

15. Nozzle according to claim 1, wherein a deflector is provided on the head, approximately at the center of the latter, so as to allow the turbulent emerging fluid to be regulated.

16. Nozzle according to claim 15, wherein the deflector has concave contour regions on the outside of the head, these being matched to the exit velocity of the turbulent emerging fluid.

17. Nozzle according to claim 15, wherein the deflector has a projecting region inside the head.

18. Nozzle according to claim 4, wherein a deflector is provided on the head approximately at the center of the latter and is made of the same material as the at least one outlet pipe.

19. Nozzle according to claim 1, wherein said head components are fixed by high-energy-density welding.

20. A blasting nozzle for the agitation of baths, comprising:

a lance head intended to be turned towards an iron-and-steelmaking melting bath or a chemical reactor, having a front face and a set of at least two substantially concentric tubes, said front face being made of a material having a high thermal conductivity, wherein said front face is attached to the said tubes by a high-energy-density welding and the aforementioned head is made of several head components, each head component being made of material chosen selectively among metallic materials which are distinct depending on the function to be fulfilled by the respective head component, the said head components all being fixed in mutual attachment zones by high-energy welding, wherein said lance head comprises at least one copper-steel attachment, and wherein a deflector is provided on the head approximately at the center of the latter and is made of the same material as at least one outlet pipe.

21. A blasting nozzle for the agitation of baths, comprising:

a lance head intended to be turned towards an iron-and-steelmaking melting bath or a chemical reactor, having a front face and a set of at least two substantially concentric tubes, said front face being made of a material having a high thermal conductivity, wherein said front face is attached to the said tubes by a high-energy-density welding and the aforementioned head is made of several head components, each head component being made of material chosen selectively among metallic materials which are distinct depending on the function to be fulfilled by the respective head component, the said head components all being fixed in mutual attachment zones by high-energy welding, wherein a deflector is provided on the head, approximately at the center of the latter, so as to allow the turbulent emerging fluid to be regulated.

22. Nozzle according to claim 21, wherein the deflector has concave contour regions on the outside of the head, these being matched to the exit velocity of the agitating flow.

23. Nozzle according to claim 21, wherein the deflector has a projecting region inside the head.

* * * * *